United States Patent [19]

Dodd

[11] 4,415,329

[45] Nov. 15, 1983

[54] WAX-ENCASED BUTANE SAFETY CANDLE

[76] Inventor: Murray B. Dodd, 5 Brookbanks Dr., #1502, Don Mills, Ontario, Canada, M3A 2S8

[21] Appl. No.: 374,495

[22] Filed: May 3, 1982

[51] Int. Cl.[3] ..... F23N 5/24

[52] U.S. Cl. ..... 431/125; 431/88; 431/344

[58] Field of Search ..... 431/33, 88, 125, 153, 431/344

[56] References Cited

U.S. PATENT DOCUMENTS

| | | | |
|---|---|---|---|
| 3,267,700 | 8/1966 | Kommer et al. | 431/125 |
| 3,336,505 | 8/1967 | Liesse | 431/125 |
| 3,360,967 | 1/1968 | Massie | 431/125 |

*Primary Examiner*—Lee E. Barrett
*Attorney, Agent, or Firm*—Murray Schaffer

[57] ABSTRACT

The decorative safety candle has the exterior appearance of a traditional moulded wax candle, but is fueled by a replaceable butane pressure cartridge. The butane cartridge is contained within an interior cylindrical metal casing, which is open at its bottom, the casing having a pair of slots at its bottom edge, adapted to removably retain a safety switch, having a downwardly extending pivotal finger, which urges the butane cylinder upwardly, when the candle is placed on a flat surface, to activate the nozzle valve of a commercially available butane cylinder. The safety switch includes a set screw whereby the gas flow may be selectively adjusted. The pivotal finger is pivoted to its upward position when the candle is not in use. When the candle is in use, in the event it is accidentally knocked over or picked up, will result in the immediate cessation of gas flow, and extinguishing of the candle flame.

3 Claims, 4 Drawing Figures

WAX-ENCASED BUTANE SAFETY CANDLE

The invention relates to a decorative candle having an exterior appearance of a traditional moulded wax candle, but is a candle which is provided with an interior replaceable butane pressure cartridge. The candle includes an adjustable safety switch, whereby in the event of the candle being accidentally knocked over, the flow of butane which fuels the candle flame will immediately and automatically cease, thus instantly extinguishing the candle flame.

It is an object of the invention to provide a decorative candle having an outer wax shell, of substantial thickness, and a replaceable interior butane cartridge, in combination with a manually adjustable safety switch, whereby a flow of butane is provided to a tubular metal wick, the flow of butane being automatically terminated in the event the candle is tipped over, or is picked up, the weight of the candle itself serving to activate the flow of butane, when the candle is placed on a flat surface.

A principal object of the invention is to provide a candle having an interior, cylindrical metal casing open at its bottom and having a unitary, central, upwardly extending tube; a wax shell surrounding said casing, said tube extending through said shell; said casing having a pair of diametrically opposed slots near its bottom, one of said slots opening at one end to the bottom of said casing; said slots being adapted to retain a removable control plate having a finger mounted for pivotal movement on its underside, near one side thereof, said finger extending below the bottom of said wax shell when pivoted to its down position; a set screw in said control plate on the side opposite said finger; said casing being adapted to contain a butane cylinder having a nozzle-valve at its top center adapted to be received in said tube and to be retained in said cylinder by said control plate; whereby, when said finger is in its down position and the candle is placed on a flat surface the weight of said candle on said finger will urge said control bar and its set screw, and thus said butane cylinder, upwardly therein to open said nozzle-valve.

These and other objects of the invention will become apparent with reference to the following description.

Reference will be made to the accompanying drawings in which.

Detailed reference will now be made to the drawings, wherein like reference numerals will identify like parts.

Figure 1:
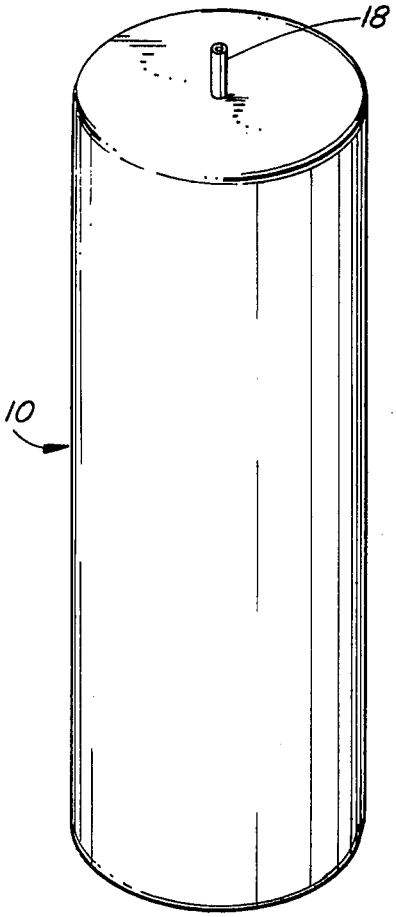
FIG. 1 is a perspective of a candle according to the invention.

A candle indicated generally at 10 includes a wax outer shell 12, of substantial thickness, and thus substantial weight, shell 12 being moulded around an inner metal cylindrical casing 14 having an interior diameter slightly larger than the exterior diameter of a standard commercially available butane cylinder 16, of the type used to refill butane cigarette lighters and the like.

Cylinder casing 14 has a unitary, central, upwardly extending tube 18, which extends slightly above the top surface of candle 10, and is the "wick" through which butane gas escapes from cylinder 16 for ignition.

Figure 2:
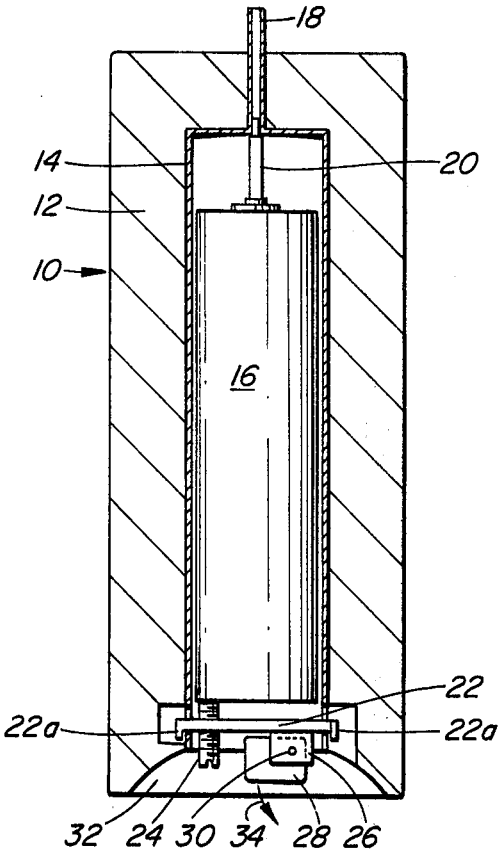
FIG. 2 is a central vertical section of the candle of FIG. 1.

Commercially available butane cylinders 16 are provided with a nozzle 20, which when depressed downwardly toward cylinder 16 activate an interior valve, as when a cigarette lighter or the like is being charged with butane. Referring to FIG. 2 it will be seen that a nozzle-valve 20 is adapted to be received in the bottom of wick-tube 18.

Figure 3:
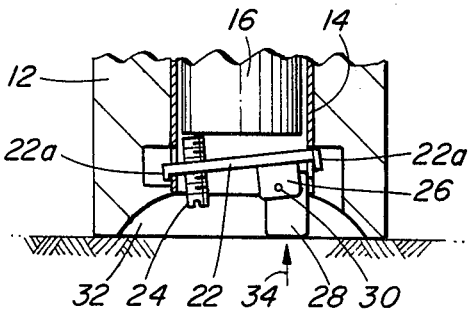
FIG. 3 is a detail in slightly enlarged view of the switch device illustrated in FIG. 2.
Figure 4:
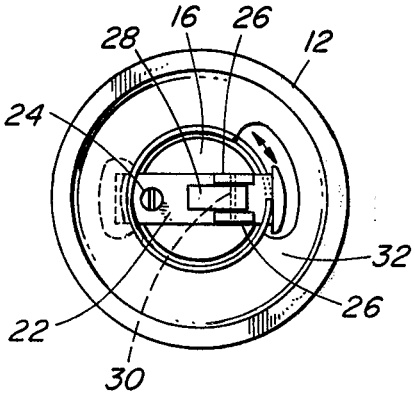
FIG. 4 is a bottom plan.

Candle 10 is controlled by a safety-switch mechanism illustrated in FIGS. 2, 3 and 4. This mechanism comprises a rectangular control plate 22 adapted to be removably engaged in a pair of slots provided near the bottom of cylinder 14, one of these slots having an opening to the bottom of cylinder 14, whereby plate 22 may be removed, as, for example, to replace butane cylinder 16 within shell 12.

Plate 22 has a unitary, downwardly extending lip **22*a* at each of its ends, and an adjustable set screw 24 is threadably engaged through plate 22 near one end thereof. As will become clear hereinafter, the volume of butane flowing through nozzle 20 and wick-tube 18 may be adjustably controlled by set screw 24**.

Near the end of plate 22 opposite set screw 24 are a pair of lugs 26 which are unitary with the underside of plate 22. A finger 28 is mounted for pivotal movement between lugs 26, by means of pin 30. Plate 22 and its related assembly are contained within a dished cavity 32 provided in the bottom of wax shell 12. It will be seen, however, that if finger 28 is pivoted downwardly in the direction of arrow 34 (see FIG. 2) that the bottom of finger 28 will project below the bottom plate of wax shell 12, that is, project downwardly beyond dished opening 32.

As seen in FIG. 3 the candle is resting on a flat surface, with finger 28 in its downwardly-extending, or operative position, and that the weight of candle 10, including the substantial mass of wax shell 12 has urged plate 22 upwardly, so that set screw 24 passes against the bottom of butane cylinder 16, to urge cylinder 16 upwardly within metal shell 14, and to force butane nozzle 20 against the bottom of wick-tube 18, to activate the valve of butane cylinder 16, and thus release butane gas through wick-tube 18.

It will be further realized in the event candle 10 is knocked over, or picked up, the spring action of the valve provided in butane cylinder 16 will force set screw 24 and plate 22 downwardly, thus closing the butane valve, and stopping a flow of gas through wick-tube 18.

Thus, the flame of wick-tube 18 will be immediately extinguished.

Referring to FIG. 3, it will be seen that when finger 28 has been pivoted downwardly to the position illustrated therein, manually, and the candle is placed on a flat surface that the weight of candle 10 will urge finger 28 upwardly within cavity 32 in the direction of arrow 34, to open butane cylinder valve and its associated nozzle 20, as described above.

It will be further appreciated that clockwise rotation of set screw 24 will effect a greater opening of the butane cylinder valve, to achieve a larger flame at the end of wick-tube 18, or that counterclockwise rotation thereof of set screw 24 will result in a smaller flame.

It will also be appreciated that candle 10 may be of any desired exterior configuration such as triangular, oval, square etc. as well as the circular shape illustrated.

The foregoing is by way of example and the invention should be limited only by the scope of the appended claims.

The embodiments of the invention in which an exclusive property or privilege is claimed are defined as follows:

1. A candle having an interior, cylindrical metal casing open at its bottom and having a unitary, central, upwardly extending tube;

a wax shell surrounding said casing, said tube extending through said shell;

said casing having a pair of diametrically opposed slots near its bottom, one of said slots opening at one end to the bottom of said casing;

said slots being adapted to retain a removable control plate having a finger mounted for pivotal movement on its underside, near one side thereof, said finger extending below the bottom of said wax shell, when pivoted to its down position;

a set screw in said control plate on the side opposite said finger;

said casing being adapted to contain a butane cylinder having a nozzle-valve at its top center adapted to be received in said tube and to be retained in said cylinder by said control plate;

whereby, when said finger is in its down position and the candle is placed on a flat surface the weight of said candle on said finger will urge said control bar and its set screw, and thus said butane cylinder, upwardly therein to open said nozzle-valve.

2. A candle according to claim 1, said set screw permitting selective adjustment of the extent said nozzle-valve is opened during use.

3. A candle according to claim 1, said control plate being removable from said casing to permit replacement of said butane cylinder.

* * * * *